United States Patent [19]

Makimoto et al.

[11] Patent Number: 4,583,064

[45] Date of Patent: Apr. 15, 1986

[54] STRIP-LINE RESONATOR

[75] Inventors: Mitsuo Makimoto, Yokohama; Morikazu Sagawa, Tokyo; Sadahiko Yamashita, Sagamihara; Yoshihiko Takayama, Miyazaki, all of Japan

[73] Assignee: Matsushita Electric Industrial Co., Ltd., Japan

[21] Appl. No.: 646,430

[22] Filed: Aug. 31, 1984

[30] Foreign Application Priority Data

| | | | |
|---|---|---|---|
| Sep. 2, 1983 | [JP] | Japan | 58-162251 |
| Sep. 2, 1983 | [JP] | Japan | 58-162252 |
| Sep. 2, 1983 | [JP] | Japan | 58-162253 |
| Sep. 2, 1983 | [JP] | Japan | 58-162254 |

[51] Int. Cl.[4] ..... H01P 7/08

[52] U.S. Cl. ..... 333/219; 333/224; 333/235; 333/246; 333/263

[58] Field of Search ..... 333/202, 204, 205, 219, 333/235, 238, 246, 220–224, 263; 331/96, 99, 101, 107 SL, 107 DP, 117 D

[56] References Cited

U.S. PATENT DOCUMENTS

| | | | |
|---|---|---|---|
| 3,337,821 | 8/1967 | Engelbrecht | 333/204 X |
| 3,656,179 | 4/1972 | De Loach | 333/238 X |

OTHER PUBLICATIONS

Heng—"Trimming of Microstrip Circuits Utilizing Microcantilever Air Gaps", IEE Trans. on Microwave Theory and Techniques, Jul. 1971, vol. MTT-19, No. 7; pp. 652–654.

*Primary Examiner*—Marvin L. Nussbaum

*Attorney, Agent, or Firm*—Lowe, Price, LeBlanc, Becker & Shur

[57] ABSTRACT

A strip-line resonator comprises a first dielectric substrate having a conductive film on one surface thereof for connection to ground and a strip line on the other surface thereof and a second dielectric substrate having one surface thereof making contact with the strip line and a conductive film on the other surface thereof for connection to ground. Fused glass having a low melting point for is applied between the first and second substrates to bond them together. A portion of open-circuit end of the strip line is exposed and formed with slits or gap to facilitate frequency adjustment.

20 Claims, 14 Drawing Figures

STRIP-LINE RESONATOR

BACKGROUND OF THE INVENTION

The present invention relates to a resonator in the VHF-UHF band for use in filters and oscillators.

Strip-line resonators have been developed for application in the VHF-UHF band to overcome problems associated with coaxial resonators. Resonators of the strip-line type comprise a pair of dielectric substrates each of which is metallized on outer surface for connection to ground. A strip line which is metallized on the inner surface of one of the substrates is sandwiched between the substrates which are bonded together by mechanical means or adhesive. One difficulty associated with the conventional strip-line resonator is that the mechanical bonding is not satisfactory for operation under vibration and the use of adhesive results in a reduction of unloaded Q value or results in a resonator which is subject to humidity.

SUMMARY OF THE INVENTION

Accordingly, the present invention provides a strip-line resonator which withstands vibration, is immune to humidity and exhibits a high Q value.

According to the invention, a strip-line resonator comprises a first dielectric substrate having a conductive film on one surface thereof for connection to ground and a strip line on the other surface thereof and a second dielectric substrate having one surface thereof making contact with the strip line and a conductive film on the other surface thereof for connection to ground. The invention is characterized by the use of a fused glass having a low melting point for bonding the first and second substrates together. Lead borosilicate glass is excellent material for this purpose.

Another object of the present invention is to provide a low-cost strip-line resonator which facilitates frequency adjustment. This object is achieved by leaving an open-circuit end portion of the strip line exposed and providing the exposed end with plural slits or forming a capacitive gap with a grounded conductor. By trimming the slitted end portion or varying the capacitive gap, the frequency of the resonator can be readily accomplished.

BRIEF DESCRIPTION OF THE DRAWINGS

The present invention will be described in further detail with reference to the accompanying drawings, in which:

FIG. 7*c* is a cross-sectional view taken along the line 7*c*—7*c* of FIG. 7*a.

DETAILED DESCRIPTION

Figure 1A:
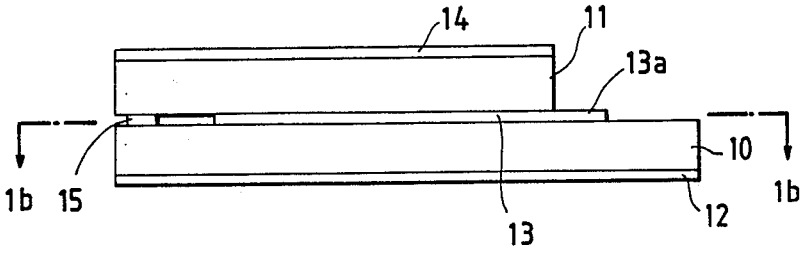
FIG. 1*a* is a side view of one embodiment of the strip-line resonator.
Figure 1B:
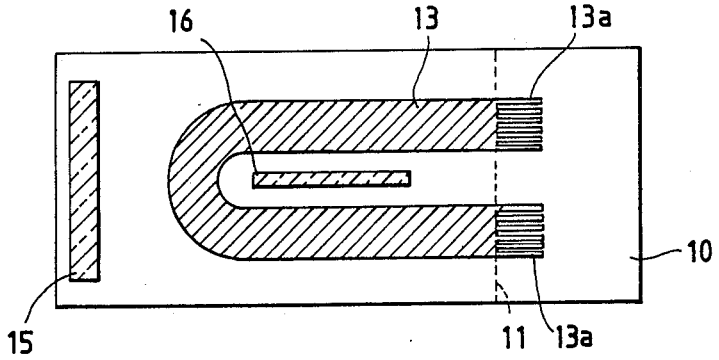
FIG. 1*b* is a cross-sectional view taken along the line 1*b*—1*b* of FIG. 1*a;*

Referring to FIGS. 1*a* and 1*b,* a half wavelength resonator of a U-shaped strip line comprises a lower substrate 10 of a dielectric material and an upper substrate 11 of a similar dielectric material. Lower substrate 10 has its lower surface entirely metallized to form a film 12 which is to be grounded. The upper surface of lower substrate 10 is metallized to form a U-configured strip line 13. Upper substrate 11 has a smaller length than the length of lower substrate 10 and has its upper surface entirely metallized to form a film 14 which is to be grounded. The lower and upper substrates are bonded together by means of fused glass of the type having a low melting point and a low dielectric loss such as lead borosilicate glass as shown at 15 and 16. The left edges of these substrates are aligned with each other so that open-circuit end portions 13*a* of the U-configured strip line 13 are exposed as illustrated. Due to the use of fused glass, upper and lower substrates 10 and 11 are strongly bonded together and the resonator is immune to temperature and humidity variations associated with conventional adhesive materials.

Figure 2:
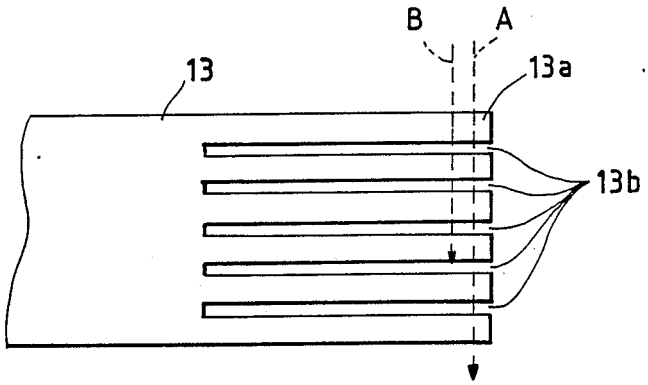
FIG. 2 is an illustration of the detail of an exposed open-circuit end portion of the strip line of FIG. 1*b;*

The frequency of the resonator is trimmed by forming a plurality of parallel slits 13*b* as shown in FIG. 2 at the open-circuit end portions 13*a* using a laser beam. The slits may be formed simultaneously as the strip line is metallized. Since the open-circuit end portions are capacitive, precision frequency adjustment is made by trimming the slitted portions transversely to a desired extent as shown at A and B while monitoring an instrument.

Figure 3A:
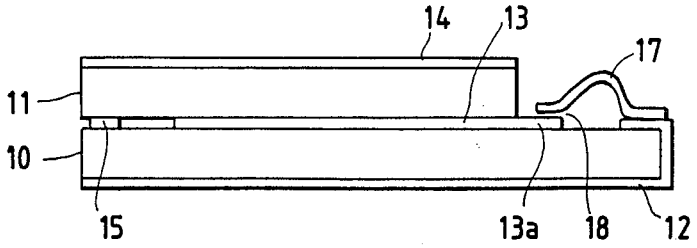
FIG. 3*a* is a side view of a second embodiment of the invention.
Figure 3B:
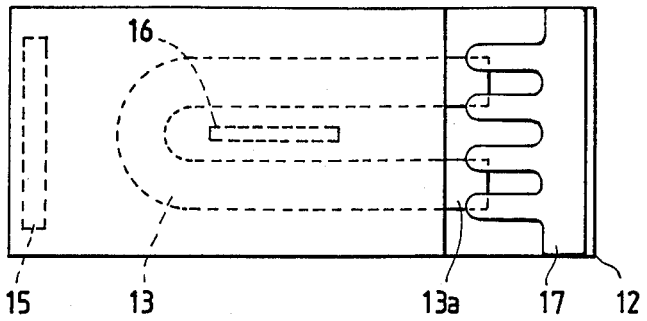
FIG. 3*b* is a plan view of the second embodiment.

A modified embodiment is shown in FIGS. 3*a* and 3*b* which differs from the previous embodiment in that instead of the slitted open-circuit end portions, the grounded conductive layer 12 is turned around the right edge of substrate 10 and a comb-like, springy conductive member 17 is bonded to the up-turned end of layer 12 and bent downwards to provide a capacitance gap 18 between it and the open-circuit ends. By appropriately adjusting the degree of the bend, the capacitance of the open-circuit ends and hence the frequency of the resonator is precisely determined.

Figure 4A:
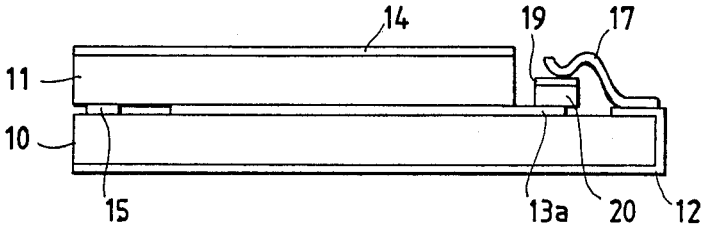
FIG. 4*a* is a side view of a modification of the second embodiment.
Figure 4B:
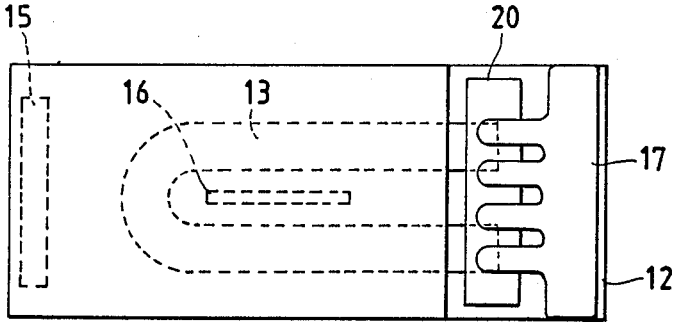
FIG. 4*b* is a plan view of the modification of FIG. 4*a;*

Alternatively, a dielectric strip 20 having a metallized film 19 is fitted under pressure in the capacitance gap 18 as shown in FIGS. 4*a* and 4*b.* Instead of adjusting the gap 18, frequency adjustment is made by moving the metallied strip 20 transversely of the open-circuit ends 13*a.* After adjustment, the comb-like member 17 is preferably soldered to the metallized film 19. This arrangement has an advantage in that by suitably choosing the material for the dielectric strip 20 it is possible to provide a wide adjustable range of frequencies or compensate for temperature variation.

Figure 5A:
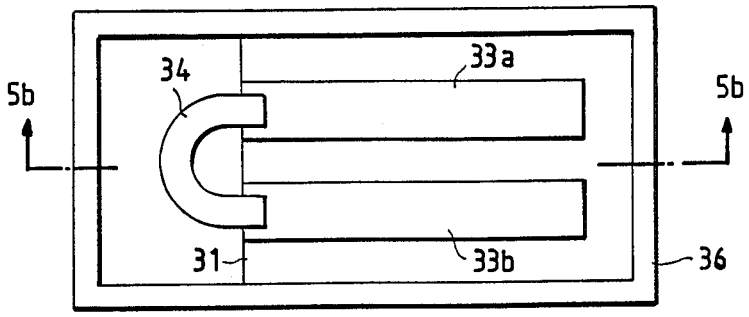
FIG. 5*a* is a plan view of a third embodiment of the invention.
Figure 5B:
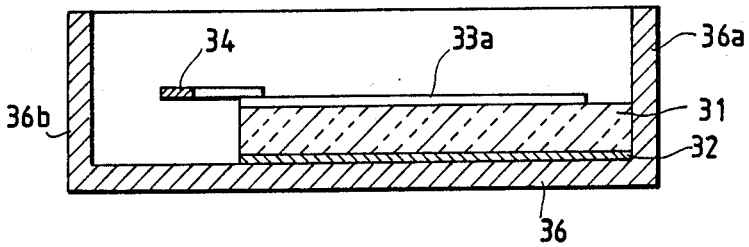
FIG. 5*b* is a cross-sectional view taken along the line 5*b*—5*b* of FIG. 5*a;*

In FIGS. 5*a* and 5*b,* a pair of rectangular parallel strips 33*a,* 33*b* are metallized on the upper surface of a dielectic substrate 31 below which is also metallized as at 32 which contacts the bottom of a metal casing 36. Strips 33*a,* 33*b* are spaced apart a distance greater than the thickness of the substrate 31 and extend from the left edge of substrate 31 to a point short of the right edge of substrate 31 which contacts with the right end wall 36*a* of casing 36 to form open-circuit ends. A generally U-shaped, plastically deformable conductive member 34 is bonded to the strips 33 so that it overhangs the left end of substrate 31 which is spaced from the left end wall 36*b* of casing 36.

The frequency of the resonator is determined by the shape and size of U-shaped end member 34 and the angle of its plane to the plane of film 33. More specifically, rough frequency adjustment is determined by the length and width of the end member and fine adjustment can be made by bending it appropriately with respect to the horizontal. The rough frequency adjustment is made by preparing a plurality of end members having different sizes to choose from. Since the metallized film is known to have an electrical resistance higher than copper or silver-plated members and since the current density is at maximum in the U-shaped end portion of the strip line, it is an advantage of the present embodiment that such a high current portion can be formed of low-resistance conductors, and hence the unloaded Q value of the resonator can be increased.

In the present embodiment the impedance ratio of the straight portion 33*a* to U-shaped portion 34 differs from the impedance ratio of straight portion 33*b* to U-shaped portion 34. Due to this difference, the spurious resonance deviates from integral multiples of the fundamental frequency. A further feature of the invention is that if the resonator is employed in a filter or the like, no response occurs at the harmonics of the fundamental frequency and spurious components can thus be effectively suppressed.

Figure 6:
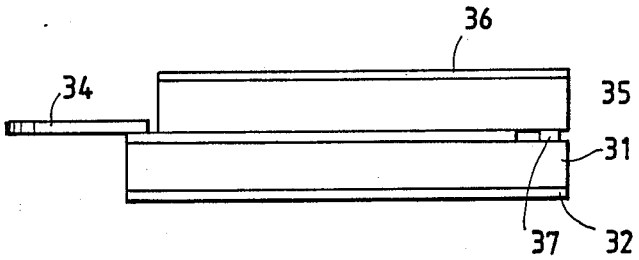
FIG. 6 is a side view of a modification of FIG. 5*a;*
Figure 7A:
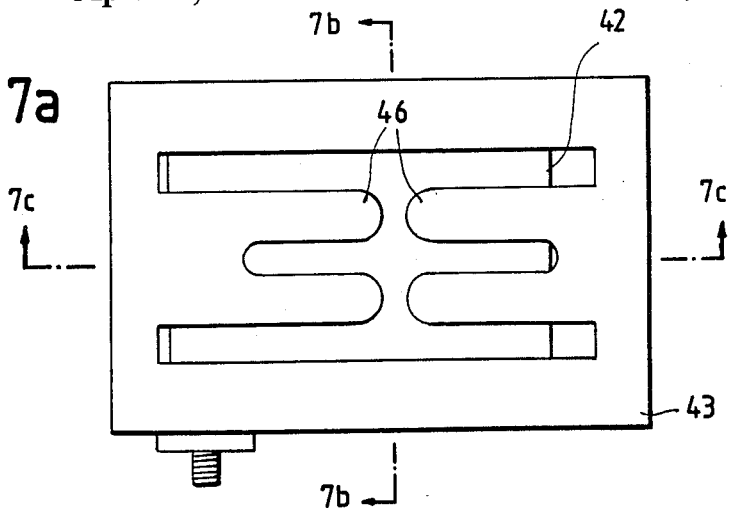
FIG. 7*a* is a plan view of a fourth embodiment of the invention.
Figure 7B:
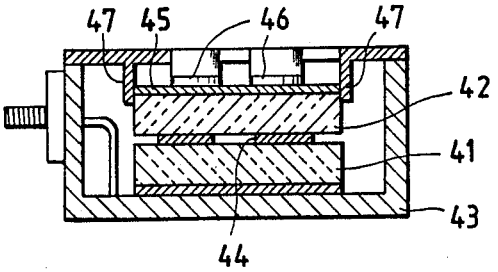
FIG. 7*b* is a cross-sectional view taken along the line 7*b*—7*b* of FIG. 7*a;*
Figure 7C:
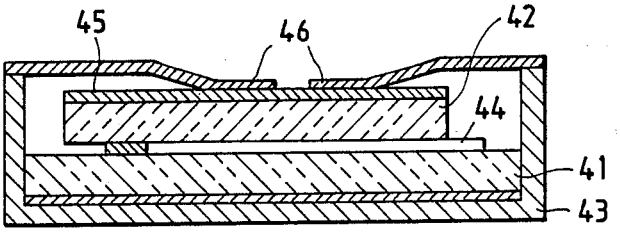

As shown in FIG. 6, the straight portions 33*a*, 33*b* are alternatively sandwiched between lower substrate 31 and upper substrate 35 which are bonded together by fused lead borosilicate glass 37. The upper surface of substrate 35 is coated with a metallized film 36 for grounding as in the embodiment of FIG. 1.

FIGS. *7a*, *7b* and *7c* are illustrations of a further embodiment of the invention. In this embodiment, lower dielectric substrate 41 has its lower surface metallized and soldered to the bottom of a metal casing 43 and has its upper surface formed with a U-shaped, metallized strip line 44. An upper dielectric substrate 42 having a smaller length than lower substrate 41 is placed on the lower substrate and has a metallized coat 45. As best shown in FIG. *7b*, the casing has an upper member having a pair of guides 47 along the length of the resonator. Upper substrate 42 is disposed in the guides so that it is movable longitudinally with respect to the lower substrate to vary its area of contact with the strip line 44, while making pressure contact with it by leaf springs 46 which form part of the upper member of the casing. Frequency adjustment is made by moving the upper substrate along the guides. The frequency is at minimum when the upper substrate is located to the right end of the casing and maximum when located to the left end. After frequency adjustment is made, leaf springs 46 are bonded to metal coat 45 by fused lead borosilicate or solder.

Figure 8:
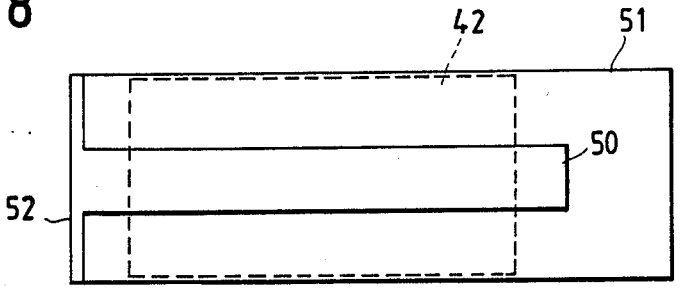
* and FIG. 8 is a plan view illustrating a modification of the embodiment of FIG. 7*a.*

While mention has been made of half wavelength resonators having open-circuit ends, the present invention could equally be as well applied to quarter wavelength resonators. One example of such resonators is shown in FIG. 8 in which the strip line is of a single rectangular shape having an open-circuit end 51 and a short-circuit end 52 which is connected to an up-turned end of a metal coat which is metallized on the lower surface of a substrate 50.

What is claimed is:

1. A resonator comprising:

a first dielectric substrate having a conductive film on one surface thereof for connection to ground and a strip line on the other surface thereof;

a second dielectric substrate having one surface thereof making contact with said strip line and a conductive film on the other surface thereof for connection to ground; and a fused glass member having a low melting point between said first and second substrates for bonding them together.

2. A resonator as claimed in claim 1, wherein said fused glass member comprises lead borosilicate glass.

3. A resonator as claimed in claim 1, wherein said strip line is of a U-shaped configuration.

4. A resonator as claimed in claim 1, wherein said strip line is of a straight line configuration.

5. A resonator as claimed in claim 1, wherein said strip line has a pair of open-circuit ends.

6. A resonator as claimed in claim 1, wherein said strip line has an open-circuit end and a short-circuit end.

7. A resonator as claimed in claim 1, wherein said strip line has an open-circuit end which is free from contact with said second substrate and formed with parallel slits.

8. A resonator as claimed in claim 1, wherein said strip line comprises a pair of parallel, first conductors metallized on said first substrate and a second conductor connected at opposite ends respectively to ends of said first conductors, said second conductor being bendable at an angle to the plane of the first substrate.

9. A resonator as claimed in claim 8, wherein said second conductor has a higher conductivity than the conductivity of said first conductors.

10. A resonator comprising:

a first dielectric substrate having a conductive film on one surface thereof for connection to ground and a strip line on the other surface thereof, said strip line having an open-circuit end with parallel slits; and a second dielectric substrate having one surface thereof making contact with said strip line leaving said open-circuit end unoccupied and a conductive film on the other surface thereof for connection to ground.

11. A resonator comprising:

a first dielectric substrate having a conductive film on one surface thereof for connection to ground and a strip line on the other surface thereof, said strip line having an open-circuit end;

a second dielectric substrate having one surface thereof making contact with said strip line leaving a portion of said open-circuit end unoccupied and a conductive film on the other surface thereof for connection to ground; and a flexible conductor connected at one end to the conductive film of said first substrate, the other end of the conductor being spaced from said unoccupied portion of said open-circuit end.

12. A resonator as claimed in claim 11, further comprising a dielectric member having a metal film thereon, the dielectric member being disposed in said adjustable gap under pressure.

13. A resonator as claimed in claim 11, wherein said first and second substrates are bonded together by fused glass having a low dielectric loss.

14. A resonator as claimed in claim 13, wherein said fused glass is lead borosilicate glass.

15. A resonator comprising:

a dielectric substrate having a conductive film on one surface thereof and a pair of parallel, metallized first conductors on the other surface thereof; and a second conductor electrically connected at opposite ends thereof respectively to ends of said metallized conductors, the second conductor being bendable at an angle to the plane of the substrate.

16. A resonator as claimed in claim 15, wherein said second conductor extends from one end of said substrate.

17. A resonator as claimed in claim 15, wherein said second conductor is detachably connected to said metallized conductors.

18. A resonator as claimed in claim 15, wherein said second conductor has a higher conductivity than the conductivity of said first conductors.

19. A resonator as claimed in claim 15, further comprising a second substrate having a conductive film on one surface, the other surface thereof making contact with said first conductors.

20. A resonator comprising:

a first dielectric substrate having a conductive film on one surface thereof for connection to ground and a strip line on the other surface thereof;

a second dielectric substrate having a conductive film on one surface thereof for connection to ground, the other surface thereof making contact with said strip line; and guide means for defining a longitudinal guide path in which said second dielectric substrate is manually moved along the length of said strip line to vary the area of contact therewith.

* * * * *